United States Patent [19]

Young

[11] Patent Number: 4,991,250

[45] Date of Patent: Feb. 12, 1991

[54] CLEANING DEVICES

[75] Inventor: Ronald A. Young, London, Great Britain

[73] Assignee: Brute Limited, West Midlands, United Kingdom

[21] Appl. No.: 440,127

[22] Filed: Nov. 21, 1989

[30] Foreign Application Priority Data

Nov. 22, 1988 [GB] United Kingdom ..... 8827233
Feb. 13, 1989 [GB] United Kingdom ..... 8903216

[51] Int. Cl.[5] ..... A47K 7/02; A47L 13/46
[52] U.S. Cl. ..... 15/228; 15/231
[58] Field of Search ..... 15/228, 231, 232, 233, 15/147 R, 147 A, 147 B, 149

[56] References Cited

U.S. PATENT DOCUMENTS

| | | | |
|---|---|---|---|
| 1,802,889 | 4/1931 | Flagstad | 15/147 |
| 3,099,855 | 8/1963 | Nash | 15/231 |
| 4,685,167 | 8/1987 | Murray | 15/228 |
| 4,852,210 | 8/1989 | Krajicek | 15/228 |

FOREIGN PATENT DOCUMENTS

| | | | |
|---|---|---|---|
| 582560 | 8/1933 | Fed. Rep. of Germany | 15/232 |

*Primary Examiner*—Henry J. Recla
*Assistant Examiner*—David J. Walczak
*Attorney, Agent, or Firm*—Collard, Roe & Galgano

[57] ABSTRACT

Cleaning devices disclosed are alternatively usable as a sweep mop in a conventional wet or damp mopping operation, or in a wiping or polishing operation. Such a device comprises a mop pad holder having attachment means for the attachment of a mop pad and for the separate attachment of a sheet of wiping or polishing material.

8 Claims, 4 Drawing Sheets

CLEANING DEVICES

BACKGROUND OF THE INVENTION

1. Field of the Invention

The invention relates to cleaning devices.

Cleaning devices are available, known as "sweep mops", which comprise a mop pad mounted on a pad holder attached to a handle so that the operative area of the pad lies flat on the surface being mopped as the mop is used with a sweeping action. Such mops are in general use for the wet or damp mopping of large surface areas.

2. Description of the Prior Art

It is frequently desired to subject a surface to a wiping or polishing treatment using a similar sweeping action, and paper or cloth "wipes" are commonly used attached to a broom-like or similar style holder. Paper or a similar material can wipe clean a surface without leaving smears.

SUMMARY OF THE INVENTION

The invention provides a cleaning device which can be used as a sweep mop in a conventional wet or damp mopping operation or alternatively in a wiping or polishing operation, to this end a mop pad holder having attachment means for the mop pad and for the separate attachment of a sheet of wiping or polishing material. Thus a dual-purpose cleaning device results which without a wiping/ polishing sheet attached can be used for wet/damp mopping or alternatively, with such a sheet attached, used for wiping or polishing of a surface.

The top wiping/polishing sheet used may, for example, be a cloth or paper wipe which can be used in either a dry or a damp condition. In the latter case the mop pad may be wetted before the top sheet is separately attached to provide a reservoir from which the sheet is continuously moistened as it is used. Alternatively, the mop pad may be removed and replaced by a a moisture retaining pad, of cotton or cellular sponge for example, which provides a reservoir for moistening the attached top sheet.

The attachment means for the mop pad may be of conventional form, the pad having end pockets into which the ends of the mop holder fit or "Velcro" (Trade Mark) type fixing strips which attach to complementary strips at the ends of the pad holder. In the former case the holder may be of articulatory collapsible construction, so that when collapsed it can be engaged in the end pockets of a pad and on erection tensions the pad across the length of the holder. Such a collapsible holder may also be used with a bucket-mounted wringer in a wet mopping system. With the Velcro strip type fastening, the mutually attached strips at each end may be held in mutual contact by end clips on the holder.

However, in preferred constructions the fixing means for the mop pad comprise slots or apertures adjacent the ends of the holder so that the latter presents end bars around which end tails of the pad can respectively be wrapped, these end portions having Velcro-type "hook and loop" surfaces so that they adhere to themselves. With end attachment slots and a collapsible holder the arrangement may be such that as the holder is erected not only does this tension the pad but end sections of the holder press down on and thus maintain the Velcro attachments. In the case of larger apertures these may effectively be closed, after the pad is fitted, by hinged closure flaps which again press down on the Velcro attachments. The separate attachment means for the wiping/polishing sheet may be mounted on these closure flaps, or be provided by these flaps themselves which engage and hold down the ends of the wiping-/polishing sheet.

The attachment means for the wiping/polishing sheet may be mounted as individual securing devices adjacent the four end corners of the pad holder so that a sheet can be wrapped around the underside of the holder and attached above the holder at the four corners. Whilst any suitable form of sheet attachment means may be employed, such means conveniently take the form of "push-in" fixings which comprise a cross-slotted resiliently flexible and membrane-like member through which the sheet can be pushed, whereupon the resilience of the member tends to close up the cross slots and the inserted sheet is gripped in a barb-like manner. The cross-slotted flexible members may be provided by attachment device units secured to the holder, or they may be moulded integrally with the latter.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
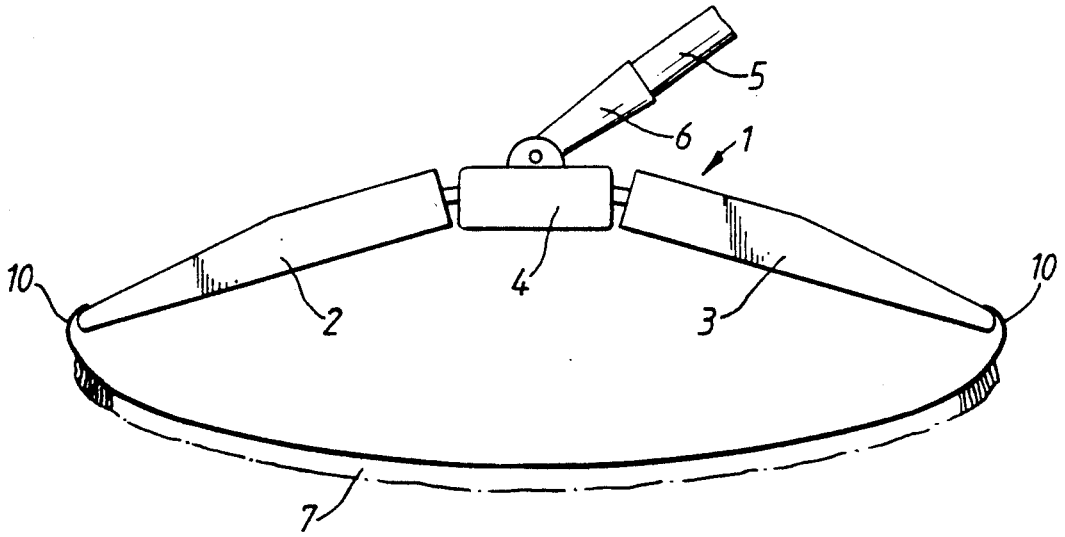
FIG. 1 is a side view of one embodiment of the invention, showing a collapsible pad holder thereof partially erected during the course of fitting a mop pad to the holder.

The device illustrated in FIGS. 1 to 6 comprises a collapsible pad holder 1 constructed with three relatively articulated sections—similar end sections 2 and 3 and a central section 4. A handle 5 of the desired length is attached by an articulatory handle mounting 6 mounted centrally on the top of the central section 4.

The pad holder 1 has attachment means for the attachment of a mop pad 7 comprising lateral through slots such as 8 moulded in the end sections 2,3, such slotting providing an end attachment bar such as 9. As can be seen from FIGS. 3 and 5, the mop pad 7 has end attachment tails such as 10 which are wrapped around the respective end attachment bars 9 of the end sections 2,3 of the holder 1. The end tails 10 are provided with Velcro type "hook and loop" attachment surfaces so that, when the overlapped sections of a tail 10 are pressed together they attach one to the other. With the holder 1 at least partially collapsed, as in FIG. 1, the mop pad 7 can be attached by its end tails 10 in this manner.

Figure 2:
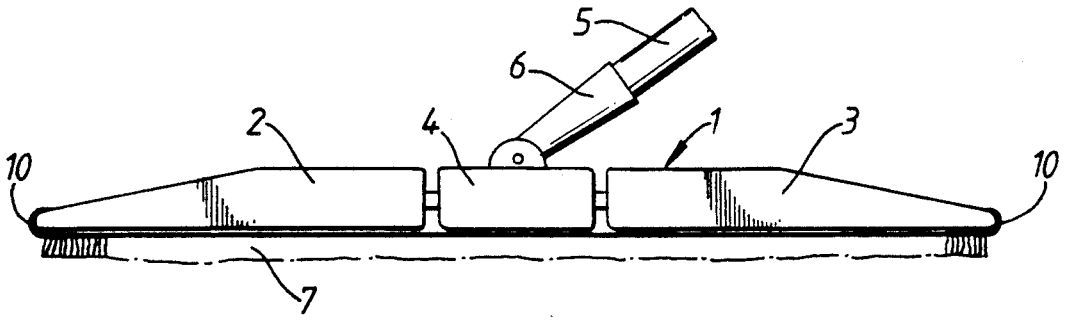
FIG. 2 is a side view with the holder fully erected.
Figure 3:
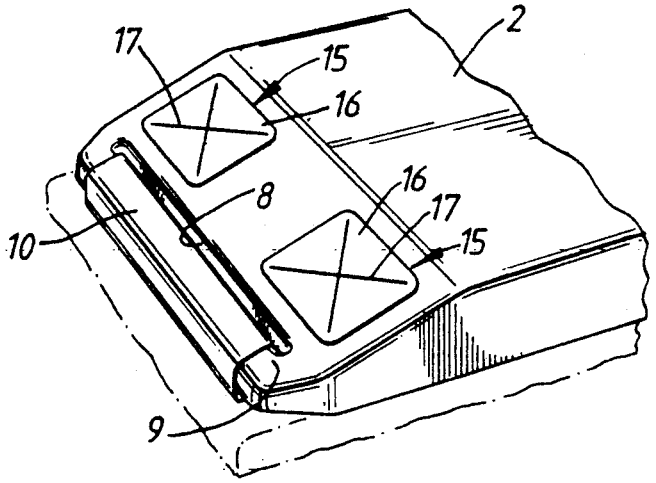
FIG. 3 is a partial perspective view, from above, of one end of the holder.

After attachment of the end tails 10 to the end sections 2 and 3, the holder 1 is fully erected as shown in FIG. 2, to bring the end sections into alignment when latch means automatically engage to maintain the erected condition, in which the mop pad 7 is under longitudinal tension so that it is held firmly against the underside of the pad holder 1. The design of these latch means and the articulatory construction of the holder 1 may be of known form and, as they are not germane to the invention, they will not be described in further detail herein.

The holder 1 is of moulded plastics construction, and (referring particularly to FIG. 6) the end section mouldings 2 and 3 are of hollow shell form with a side wall such as 11, and internal longitudinal strengthening webs 12 joined to a wall 13 which surrounds the slot 8. As can be seen from FIG. 5, in the erected condition the inner side edge 14 of the wall 13 at each end of the holder 1 presses against the overlapped sections of the corresponding end tail 10 of the mop pad 7. This holds the overlapped sections, with the Velcro engagement, firmly together.

For use with a paper "wipe", or other desired wiping-/polishing sheet material, the sheet of such material is wrapped over the erected holder 1 and mop pad 7 so as to cover the operative surface of the latter. It is secured in position by separate and independent attachment means comprising, adjacent the four corners of the holder 1, individual "push in" securing devices 15. The devices 15 may be moulded integrally with the end sections 2,3 or separately formed and mounted thereon, for example secured thereto by adhesive. Each device 15 comprises a flexible resilient membrane 16 with a cross slot 17 through which a corner of the wiping/polishing sheet can be inserted so as to be gripped resiliently by the membrane 16 as the resilience thereof tends to close up the cross slot 17. Furthermore, due to having been pushed in at the slot 17, the flexed membrane engages the attached sheet (not shown) with a barb-like gripping action so that the sheet is securely attached.

Figure 4:
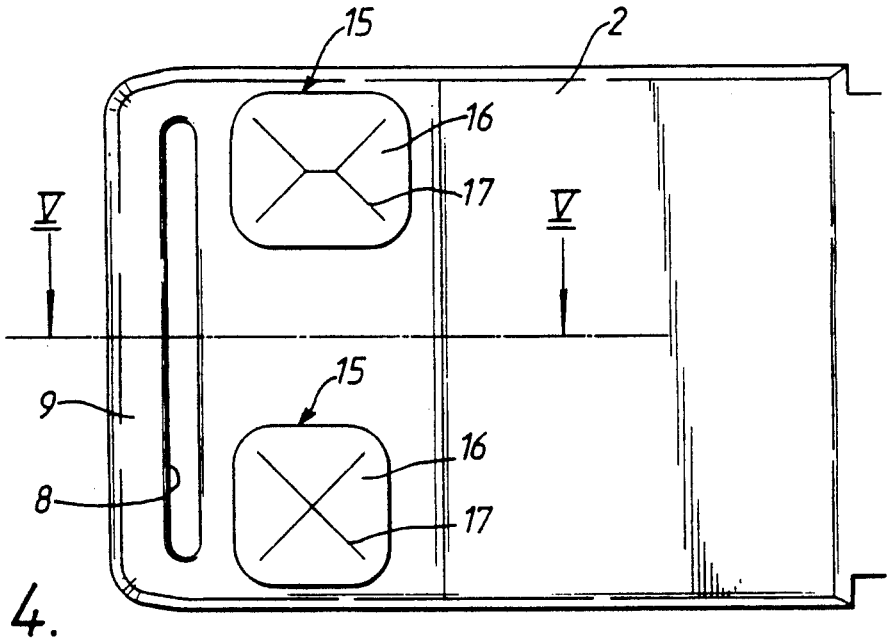
FIG. 4 is a plan view of said end of the holder.
Figure 5:
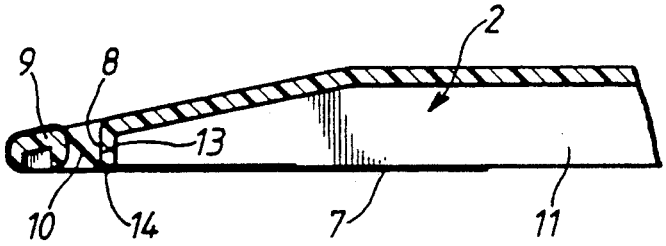
FIG. 5 is a cross-sectional view on the line V—V in FIG. 4.
Figure 6:
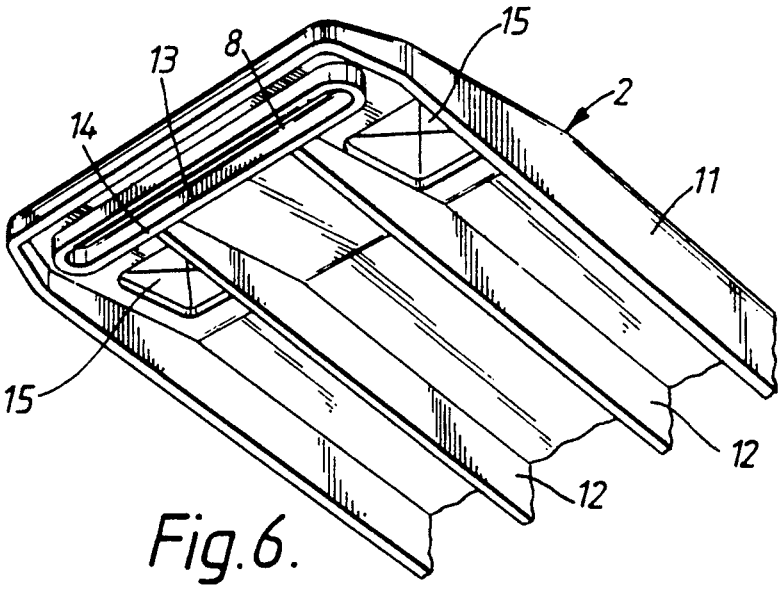
FIG. 6 is an underneath perspective view of said end of the holder.
Figure 7:
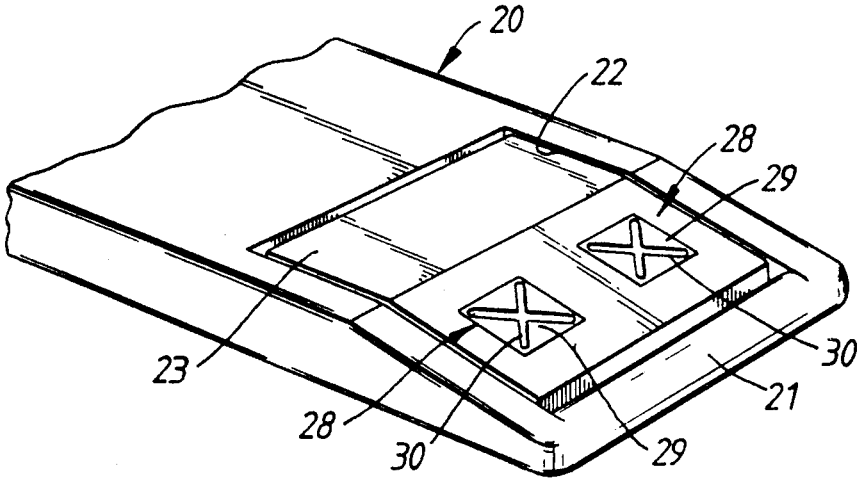
FIGS. 7 to 10 are views which correspond to that of FIG. 3 but are of another embodiment showing various states thereof.
Figure 8:
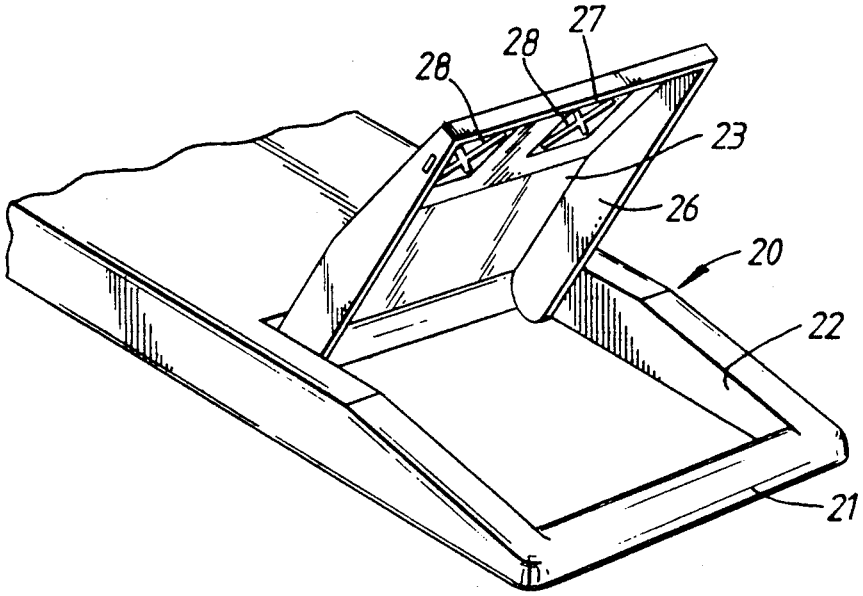

FIG. 4 shows, in respect of the two sheet attachment devices 15 illustrated therein, alternative forms of the cross slot 17 which might be used in this embodiment. It will be appreciated that in practice one or other of these would be selected, all four devices 15 being identical.

The device of FIGS. 7 to 10 is similar to that of the earlier figures except for the outer ends of the end sections one of which, referenced 20, is partially shown in overhead perspective in these later figures. As before the end section 20 has an end attachment bar 21, this now being defined not by a transverse slot but by a moulded-in rectangular through aperture 22. The aperture 22 is normally filled by a hinged closure flap 23 which pivots about a lateral axis at the inner end of the aperture 22. The flap 23 is spring loaded about the hinge axis towards the normal closed position illustrated in FIG. 7.

Figure 9:
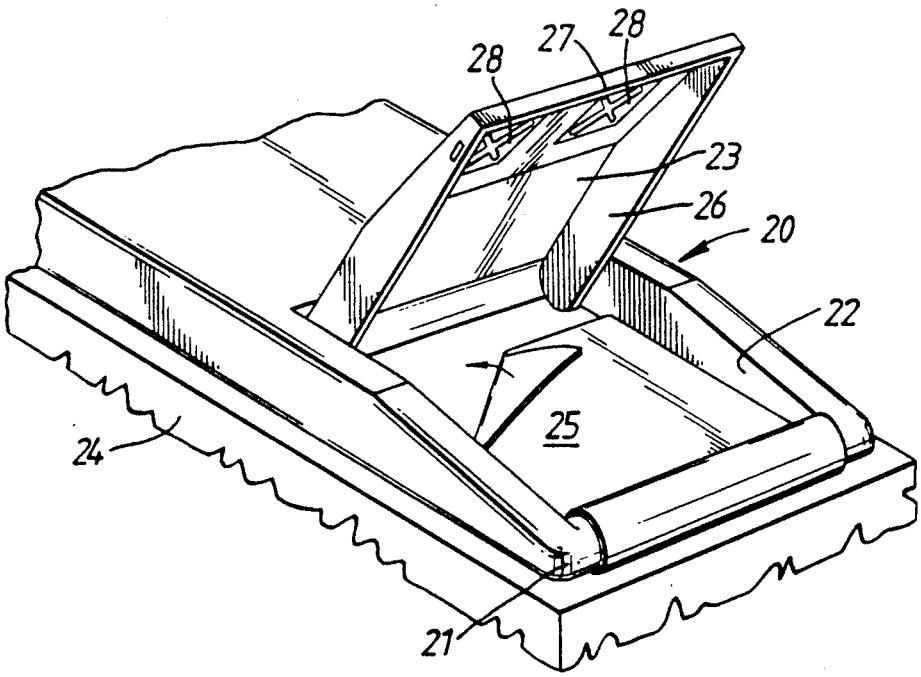
Figure 10:
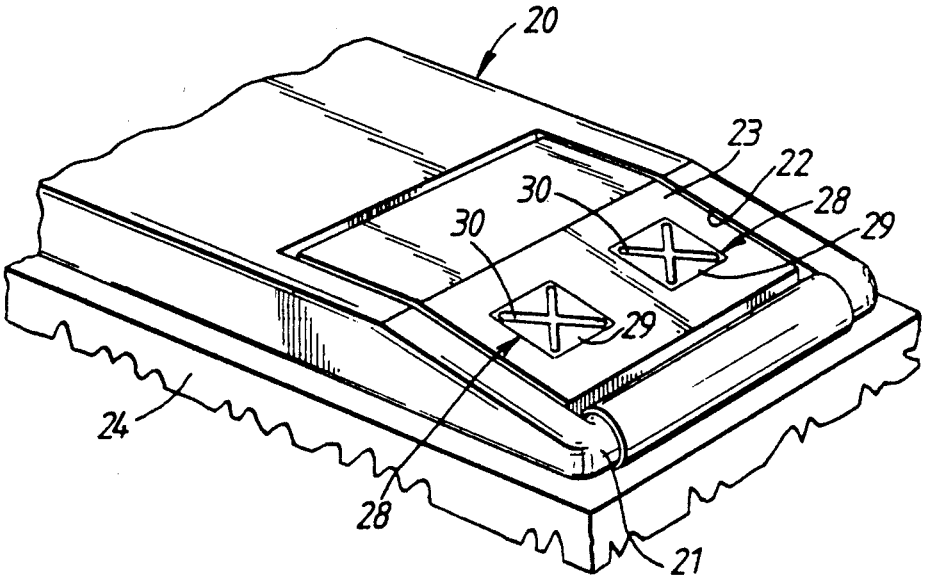

As before, the end bars such as 21 provide attachment means for a mop pad 24. To attach the pad 24 the closure flaps such as 23 are lifted to the position shown in FIG. 8, allowing the end tails such as 25 of the pad 24 to be wrapped around the end bars and the overlapped portions thereof fastened to each other as illustrated in FIG. 9. The flaps such as 23 are then released, so as to move under the spring loading to the closed position as illustrated in FIG. 10 when they press down on the respective end tails 25. Each flap 23 is a hollow moulding with a side wall 26 which, at the outer side of the flap, has a bottom edge 27 which engages and holds down the corresponding end tail 25 in the same manner as the edge 14 of the wall 13 in the earlier embodiment.

The separate and independent attachment means of the invention, for attachment of a wiping/polishing sheet are again provided by four "push-in" securing devices 28. Thus each of the devices 28 comprises a flexible resilient membrane 29 with a cross slot 30, and they are respectively disposed adjacent the four corners of the holder. The devices 28 are mounted on the closure flaps 23.

It will also be appreciated from the foregoing description that the invention provides a dual-purpose cleaning device usable, alternatively, as a normal sweep mop for wet or damp mopping or, with an attached covering sheet (with or without a mop pad attached beneath it), for wiping or polishing according to the nature of the attached sheet. Furthermore, the attached sheet can be kept continuously moistened, should this be desired, by attaching and wetting the mop pad 7 before the top sheet is separately attached over it by means of the attachment devices 15. The wiping/polishing sheet may be of any desired material, typically of paper, paper-like, cotton or synthetic fibrous material, woven or non-woven. When used over a wetted mop pad it may be of a porous nature such that a controlled flow of moisture maintains its outer surface just slightly moistened to provide a "damp wipe" condition.

While I have illustrated and described my invention in its preferred forms, it will be apparent that the same are subject to alteration and modification without departing from the underlying principles involved, and I accordingly do not desire to be limited to the specific details illustrated and described except as may be necessitated by the appendant claims.

What is claimed is:

1. A cleaning device alternatively usable as a sweep mop in a conventional wet or damp mopping operation, or in a wiping or polishing operation, comprising a mop pad holder having four end corners and attachment means for a mop pad having end tails and for the separate attachment of a sheet of wiping or polishing material, said attachment means comprising slots or apertures adjacent the ends of the holder so that the latter presents end bars around which end tails of the pad can respectively be wrapped, these end portions having complementary hook and loop type surfaces so that they adhere to themselves, and said apertures being effectively closed, after the mop pad is fitted, by hinged closure flaps which are respectively located within the apertures and press down on and thus maintain the hook an loop type attachments of the mop pad.

2. A cleaning device according to claim 1, wherein the attachment means for the wiping/polishing sheet are provided on said closure flaps.

3. A cleaning device according to claim 1, wherein the attachment means for the wiping/polishing sheet are provided by said closure flaps which engage and hold down the ends of the wiping/polishing sheet.

4. A cleaning device according to claim 1, wherein the attachment means for the wiping/polishing sheet are provided as individual securing devices adjacent the four end corners of the pad holder so that a sheet can be wrapped around the underside of the holder and attached above the holder at the four corners.

5. A cleaning device according to claim 4, wherein the sheet attachment means take the form of "push-in" fixings which each comprise a cross-slotted resiliently flexible and membrane-like member through which the sheet can be pushed, whereupon the resilience of the member tends to close up the cross slots and the inserted sheet is gripped in a barb-like manner.

6. A cleaning device according to claim 5, wherein the attachment means for the mop pad comprise slots or apertures adjacent the ends of the holder so that the latter presents end bars around which end tails of the pad can respectively be wrapped with said apertures effectively being closed, after the mop pad is fitted, by hinged closure flaps which press down on and thus maintain the attachments of the end tails of the mop pad, and said cross-slotted flexible members of the securing devices are moulded integrally with the closure flaps.

7. A cleaning device alternatively usable as a sweep mop in a conventional wet or damp mopping operation, or in a wiping or polishing operation, comprising a mop pad holder having four end corners and attachment means for the mop pad and for the separate attachment of a sheet of wiping or polishing material, wherein the attachment means for the wiping/polishing sheet comprise individual securing devices disposed adjacent the four end corners of the pad holder so that a sheet can be wrapped around the underside of the holder and attached above the holder at the four corners, each said securing device being in the form of a push-in fixing which comprises a cross-slotted resiliently flexible and membrane-like member through which the sheet can be pushed, whereupon the resilience of the member tends to close up the cross slots and the inserted sheet is gripped in a barb-like manner, and the attachment means for the mop pad comprise slots or apertures adjacent the ends of the holder so that the latter presents end bars around which end tails of the pad can respectively be wrapped with said apertures effectively being closed, after the mop pad is fitted, by hinged closure flaps which press down on and thus maintain the attachments of the end tails of the mop pad, the cross-slotted flexible members of said securing devices being molded integrally with the closure flaps.

8. A cleaning device alternatively usable as a sweep mop in a conventional wet or damp mopping operation, or in a wiping or polishing operation, comprising a mop pad holder having attachment means for a mop pad having end tails and for the separate attachment of a sheet of wiping or polishing material, said attachment means comprising slots or apertures adjacent the ends of the holder so that the latter presents end bars around which end tails of the pad can respectively be wrapped, these end portions having complementary hook and loop type surfaces so that they adhere to themselves, said attachment means having hinged closure flaps which are respectively located within the apertures which, after the mop pad is fitted, press down on and thus maintain the hook and loop type attachments of the mop pad.

* * * * *